US006784768B1

(12) United States Patent
Pance et al.

(10) Patent No.: US 6,784,768 B1
(45) Date of Patent: Aug. 31, 2004

(54) METHOD AND APPARATUS FOR COUPLING ENERGY TO/FROM DIELECTRIC RESONATORS

(75) Inventors: Kristi Dhimiter Pance, West Boston, MA (US); Eswarappa Channabasappa, Acton, MA (US); Adil Khalil, Lowell, MA (US)

(73) Assignee: M/A - Com, Inc., Lowell, MA (US)

( * ) Notice: Subject to any disclaimer, the term of this patent is extended or adjusted under 35 U.S.C. 154(b) by 0 days.

(21) Appl. No.: 10/410,781

(22) Filed: Apr. 9, 2003

(51) Int. Cl.[7] ..... H01P 7/10
(52) U.S. Cl. ..... 333/219; 333/222
(58) Field of Search ..... 333/219, 219.1, 333/222, 224, 225, 230, 231, 232

(56) References Cited

U.S. PATENT DOCUMENTS 5,347,246 A * 9/1994 Bellows et al. ..... 333/219.1
6,208,227 B1 * 3/2001 Remillard et al. ..... 333/219

* cited by examiner

*Primary Examiner*—Timothy P. Callahan
*Assistant Examiner*—Linh M. Nguyen

(57) ABSTRACT

The invention is a method and apparatus for coupling energy into or out of a dielectric resonator circuit by means of a coupling loop. More particularly, the invention is a method and apparatus for adjustably mounting a coupling loop relative to a resonator, the method and apparatus particularly adapted for use with conical and similar resonators in which the field of interest, typically the TE mode, varies as a function of longitudinal position relative to the resonator.

30 Claims, 10 Drawing Sheets

METHOD AND APPARATUS FOR COUPLING ENERGY TO/FROM DIELECTRIC RESONATORS

FIELD OF THE INVENTION

The invention pertains to dielectric resonators circuits. More particularly, the invention pertains to techniques for coupling energy to and from dielectric resonator circuits.

BACKGROUND OF THE INVENTION

Dielectric resonators are used in many circuits, particularly microwave circuits, for concentrating electric fields. They can be used to form filters, oscillators, triplexers and other circuits. The higher the dielectric constant of the dielectric material of which the resonator is formed, the smaller the space within which the electric fields are concentrated. Suitable dielectric materials for fabricating dielectric resonators are available today with dielectric constants ranging from approximately 10 to approximately 150 (relative to air). These dielectric materials generally have a mu (magnetic constant) of 1, i.e., they are transparent to magnetic fields.

FIG. 1 is a perspective view of a typical dielectric resonator of the prior art. As can be seen, the resonator 10 is formed as a cylinder 12 of dielectric material with a circular, longitudinal through hole 14. Individual resonators are commonly called "pucks" in the relevant trades. While dielectric resonators have many uses, their primary use is in connection with microwave communication systems.

As is well known in the art, dielectric resonators and resonator filters have multiple modes of electrical fields and magnetic fields concentrated at different center frequencies. A mode is a field configuration corresponding to a resonant frequency of the system as determined by Maxwell's equations. In a dielectric resonator, the fundamental resonant mode frequency, i.e., the lowest frequency, is the transverse electric field mode, $TE_{01\delta}$ (or TE hereafter). Typically, it is the fundamental TE mode that is the desired mode of the circuit or system in which the resonator is incorporated. The second mode is commonly termed the hybrid mode, $H_{11\delta}$ (or $H_{11}$ hereafter). The $H_{11}$ mode is excited from the dielectric resonator, but a considerable amount of electric field lies outside of the resonator and, therefore, is strongly affected by the cavity. The $H_{11}$ mode is the result of an interaction of the dielectric resonator and the cavity within which it is positioned and has two polarizations. The $H_{11}$ mode field is orthogonal to the TE mode field. There are additional higher order modes.

Typically, all of the modes other than the TE mode, are undesired and constitute interference. The $H_{11}$ mode, however, often is the only interference mode of significant concern because it tends to be rather close in frequency to the TE mode. However, the $TM_{01\delta}$ or $TM_{01}$ (Transverse Magnetic) mode also can be of concern. The longitudinal through hole 14 in the resonator helps to push the frequency of the Transverse Magnetic mode upwards. However, during the tuning of a filter, the frequency of the Transverse Magnetic mode could be brought downward and close to the operating band of the filter. The remaining higher order modes usually have substantial frequency separation from the TE mode and thus do not cause significant interference with operation of the system.

FIG. 2 is a perspective view of a microwave dielectric resonator filter 20 of the prior art employing a plurality of dielectric resonators 10. The resonators 10 are arranged in the cavity 22 of a conductive enclosure 24. The conductive enclosure 24 typically is rectangular, as shown in FIG. 2. Microwave energy is introduced into the cavity by a coupler 28 coupled to a cable, such as a coaxial cable. Conductive separating walls 32 separate the resonators from each other and block (partially or wholly) coupling between physically adjacent resonators 10. Particularly, irises 30 in walls 32 control the coupling between adjacent resonators 10. Walls without irises generally prevent any coupling between adjacent resonators separated by those walls. Walls with irises allow some coupling between adjacent resonators separated by those walls. By way of example, the field of resonator 10*a* couples to the field of resonator 10*b* through iris 30*a*, the field of resonator 10*b* further couples to the field of resonator 10*c* through iris 30*b*, and the field of resonator 10*c* further couples to the field of resonator 10*d* through iris 30*c*. Wall 32*a*, which does not have an iris, prevents the field of resonator 10*a* from coupling with physically adjacent resonator 10*d* on the other side of the wall 32*a*.

One or more metal plates 42 are attached to a top cover plate (the top cover plate is not shown) generally coaxially with a corresponding resonator 10 to affect the field of the resonator to set the center frequency of the filter. Particularly, plate 42 may be mounted on a screw 43 passing through a threaded hole in the top cover plate (not shown) of enclosure 24. The screw may be rotated to vary the spacing between the plate 42 and the resonator 10 to adjust the center frequency of the resonator. The sizes of the resonator pucks 10, their relative spacing, the number of pucks, the size of the cavity 22, and the size of the irises 30 all need to be precisely controlled to set the desired center wavelength of the filter and the bandwidth of the filter.

An output coupler 40 is positioned adjacent the last resonator 10*d* to couple the microwave energy out of the filter 20 and into a coaxial connector (not shown). Signals also may be coupled into and out of a dielectric resonator circuit by other techniques, such as microstrips positioned on the bottom surface 44 of the enclosure 24 adjacent the resonators.

FIG. 3 shows one typical coupling element design that can be used as the input coupler 28 or output coupler 40 in the dielectric resonator circuit of FIG. 2. The resonator is shown at 31. The coupler 38 is mounted through the wall 32 of the resonator circuit and couples, for instance, to a coaxial cable 33 that carries a signal to or from the resonator circuit. The coupler 38 comprises a conductive loop 35 that is generally coaxial with and surrounds the dielectric resonator 31. The coupling loop can be an electric coupling loop or a magnetic coupling loop. Despite the terminology (which is conventional), coupling is predominantly magnetic in either case. Also, the coupling loop can be open or closed. If the loop is closed, the loop is fully coupled to the magnetic flux of the resonator. If the loop is open, it is only partially coupled to the magnetic flux of the resonator. For exemplary purposes, FIG. 3 shows an open, magnetic coupling loop that extends around the resonator 31 approximately 270°. An electric coupling loop, on the other hand, operates on the principal of capacitive coupling through a conductive plate positioned near the resonator.

Achieving a particular coupling strength between the loop and the resonator is crucial to meeting the desired filter specifications, especially return loss. Hence, selection of an appropriate type of coupling loop and appropriate selection of its other attributes, such as radius, position relative to the resonator and length of the wire, are essential to achieving such goals. One particularly significant attribute is the distance between the loop and the resonator 31. An adjusting screw 36 is mounted on the far side of the enclosure 37 opposite from the wall. In this particular design, there is another wall 39 of the enclosure 37 at that position and, thus, the adjusting screw 36 passes through and threadingly engages a hole 38 in the far wall 37. The adjusting screw 36 is nonconductive and can contact the loop 35 as shown in FIG. 3. By rotating the screw 36 so as to screw it into the cavity (to the left in FIG. 3), the distal end of the screw can contact the loop 35 and push it closer to the resonator, thus, increasing coupling. Likewise, by rotating the screw outwardly (to the right in FIG. 3), the loop can resiliently spring back out, thus moving further away from the resonator 31 and decreasing coupling strength.

As should be obvious, the adjusting screw 36 tends to deform the loop 35 so that it is not a perfect circle (or portion of a circle). This can cause coupling to be uneven, which is undesirable, and only has a fairly limited effect on the coupling strength between the loop and the resonator. Accordingly, the adjustment of the coupling strength by this technique is very limited and there is a need for an improved method and apparatus for adjusting the relative positions of a resonator and a coupling loop for tuning of the circuit.

Prior art resonators and the circuits made from them have many drawbacks. For instance, the volume and configuration of the conductive enclosure 24 substantially affects the operation of the system. Particularly, the enclosure minimizes radiative loss. However, it also has a substantial effect on the center frequency of the TE mode. Accordingly, not only must the enclosure be constructed of a conductive material, but it must be very precisely machined to achieve the desired center frequency performance, thus adding complexity and expense to the fabrication of the system.

Even further, prior art resonators have poor mode separation between the desired TE mode and the undesired $TM_{01}$ and $H_{11}$ modes.

Furthermore, as a result of the positions of the fields within the resonators, prior art resonators have limited ability to couple with microstrips, coupling loops, and other resonators. Thus, filters made from prior art resonators have limited bandwidth range. Further, prior art dielectric resonator circuits, such as the filter shown in FIG. 2, suffer from poor quality factor, Q, due to the presence of separating walls and coupling screws. Q essentially is an efficiency rating of the system and, more particularly, is the ratio of stored energy to lost energy in the system. The fields generated by the resonators touch all of the conductive components of the system, such as the enclosure 20, plates 42, internal walls 32 and 34, and adjusting screws 43, and inherently generate currents in those conductive elements. Those currents essentially comprise energy that is lost from the circuit.

SUMMARY OF THE INVENTION

The invention is a method and apparatus for coupling energy into or out of a dielectric resonator circuit by means of a coupling loop. More particularly, the invention is a method and apparatus for adjustably mounting a coupling loop relative to a resonator, the method and apparatus particularly adapted for use with conical and similar resonators in which the field of interest, typically the TE mode, varies as a function of longitudinal position relative to the resonator. In accordance with the invention, the coupling loop is supported from the distal end of a threaded screw that passes through a matingly threaded hole in the housing The resonator to which the loop is to couple is mounted on the distal end of a second threaded screw that passes through a matingly threaded central passage in the first screw. The position of the resonator, therefore, is longitudinally adjustable relative to the coupling loop by rotation of the second screw relative to the first screw. The resonator is longitudinally adjustable relative to the housing and the other resonators in the circuit by rotation of either the first screw or the second screw. By relative adjustment of the first and second screws to each other, the longitudinal position of the coupling loop relative to the resonator can be adjusted, thereby adjusting the coupling strength between the two. With this mounting technique, the coupling loop can be positioned very closely to the resonator to maximize field coupling. Furthermore, the coupling strength is adjustable by longitudinal adjustment of the coupling loop relative to the conical resonator.

DETAILED DESCRIPTION OF THE INVENTION

A. Conical Resonators and Circuits Using Them

U.S. patent application Ser. No. 10/268,415, which is fully incorporated herein by reference, discloses new dielectric resonators and circuits using such resonators. One of the key features of the new resonators disclosed in the aforementioned patent application is that the field strength of the TE mode field outside of and adjacent the resonator varies along the longitudinal dimension of the resonator. As disclosed in the aforementioned patent application, a key feature of the new resonators that helps achieve this goal is that the cross-sectional area of the resonator measured parallel to the field lines of the TE mode varies along the longitude of the resonator perpendicular to TE mode field lines. In preferred embodiments, the cross-section varies monotonically as a function of the longitudinal dimension of the resonator. In one particularly preferred embodiment, the resonator is conical, as discussed in more detail below. Even more preferably, the cone is a truncated cone.

Figure 4:
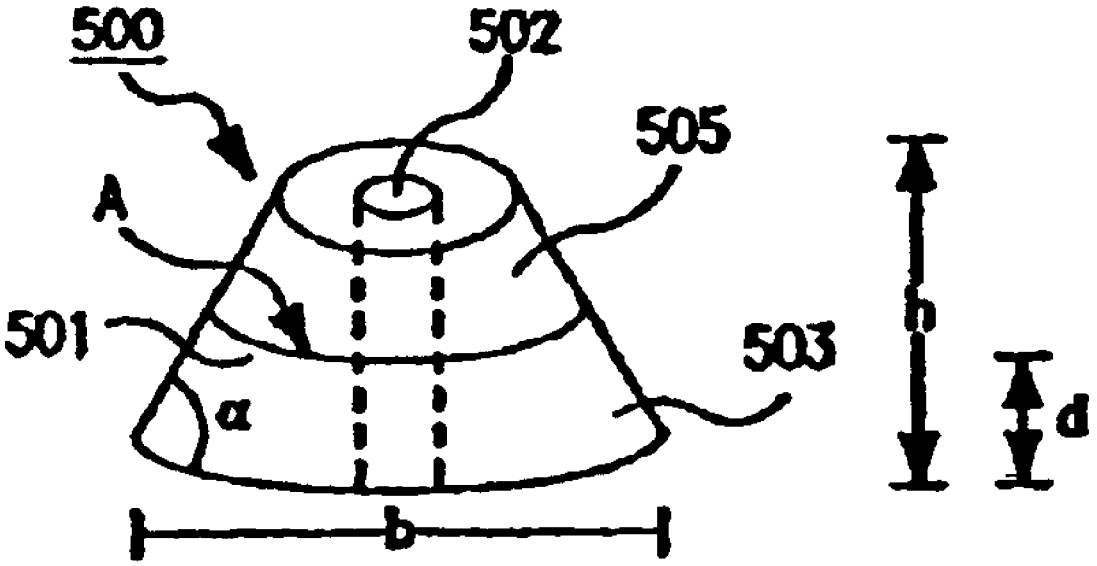
FIG. 4 is a perspective view of a conical dielectric resonator in connection with which the present invention is particularly suitable.

FIG. 4 is a perspective view of an exemplary embodiment of a dielectric resonator in accordance with the aforementioned patent application. As shown, the resonator 500 is formed in the shape of a truncated cone 501 with a central, longitudinal through hole 502. As in the prior art, the primary purpose of the through hole is to suppress the Transverse Magnetic ($TM_{01}$,) mode. The $TM_{01}$, mode can come quite close in frequency to the working band of the filter (i.e., the frequency of the TE mode) during tuning of the filter when using conventional, cylindrical resonators. However, conical resonators destroy the homogeneity of epsilon filled space in the longitudinal direction of the resonator. This aspect of conical resonators together with a longitudinal through hole of an appropriate diameter in the resonator can substantially reduce the magnitude of $TM_{01}$ mode excitation compared to conventional cylindrical resonators. The conical shape causes the TE mode field to be located in a physically spaced volume from the $H_{11}$ mode field.

Figure 5A:
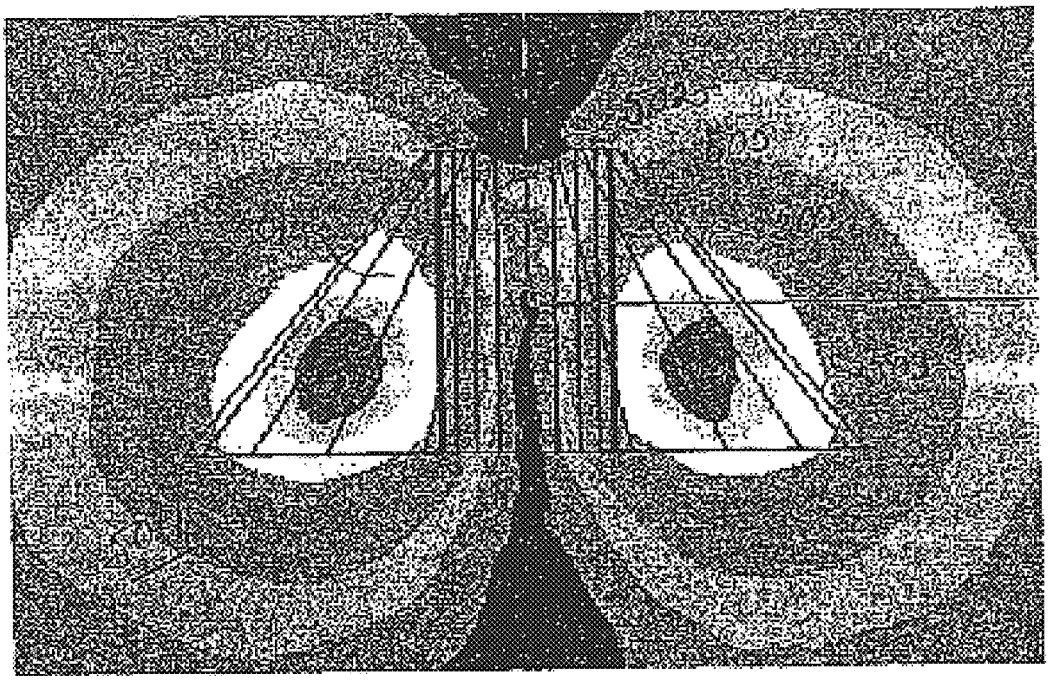
FIG. 5A is a cross sectional view of the conical dielectric resonator of FIG. 4 illustrating the distribution of the TE mode electric field.
Figure 5B:
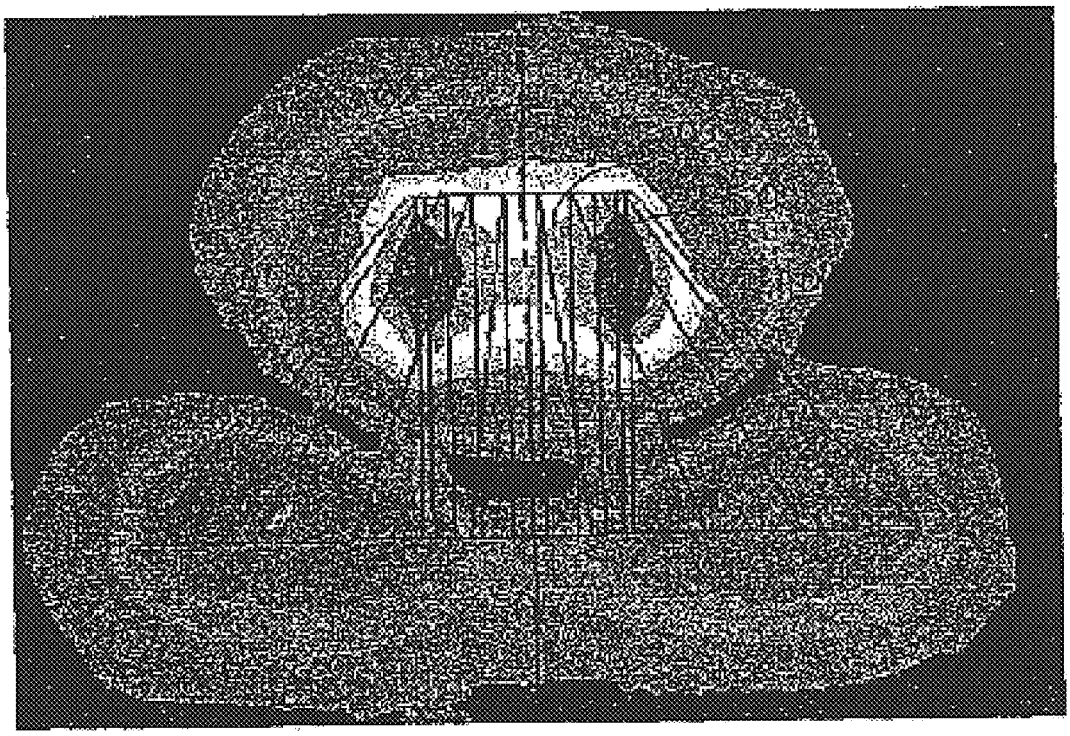
FIG. 5B is a cross sectional view of the dielectric resonator of FIG. 4 illustrating the distribution of the $H_{11}$ mode electric field.

Referring to FIGS. 5A and 5B, the TE mode electric field 504 (FIG. 5A) tends to concentrate in the base 503 of the resonator because of the transversal components of the electric field. However, the $H_{11}$ mode electric field 506 (FIG. 5B) tends to concentrate at the top (narrow portion) 505 of the resonator because of the vertical components of the electric field. The longitudinal displacement of these two modes improves performance of the resonator (or circuit employing such a resonator) because the conical dielectric resonators can be positioned adjacent other microwave devices (such as other resonators, microstrips, tuning plates, and input/output coupling loops) so that their respective TE mode electric fields are close to each other and strongly couple while their respective $H_{11}$ mode electric fields remain further apart from each other and, therefore, do not couple to each other nearly as strongly. Accordingly, the $H_{11}$ mode would not couple to the adjacent microwave device nearly as much as in the prior art where the TE mode and the $H_{11}$ mode are located much closer to each other.

In addition, the mode separation (i.e., frequency spacing) is increased in the conical resonators of the present invention.

The radius of the longitudinal through hole should be selected to optimize insertion loss, volume, spurius response, and other properties. Further, the radius of the longitudinal through hole can be variable. For instance, it may comprise one or more steps.

Figure 6:
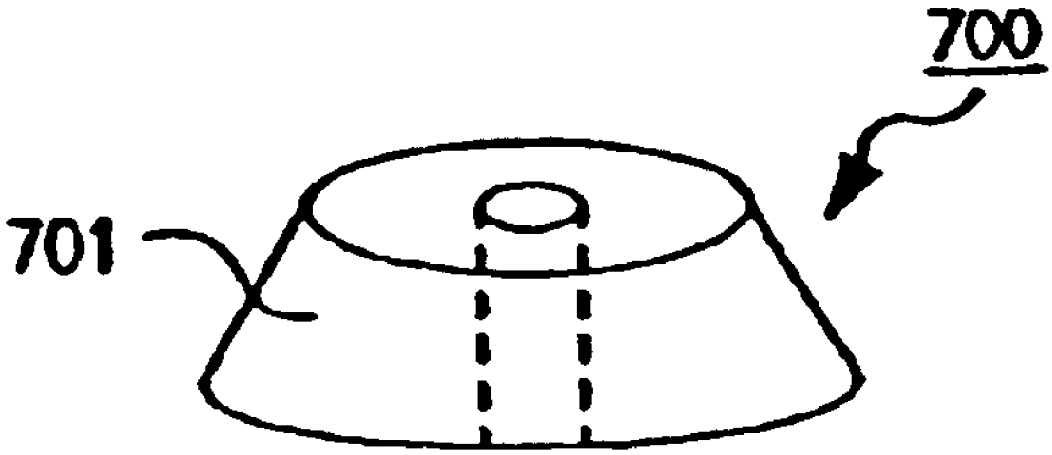
FIG. 6 is a side cross sectional view of another conical dielectric resonator for use in connection with the present invention is particularly suitable.

FIG. 6 shows an even more preferred embodiment of the conical resonator of application Ser. No. 10/268,415 in which the body 701 of the resonator 700 is even further truncated. Particularly, relative to the exemplary resonator illustrated in FIG. 4, one may consider the resonator of FIG. 6 to have its top removed. More particularly, the portion of the resonator in which the $H_{11}$ mode field was concentrated in the FIG. 4 embodiment is eliminated in the FIG. 6 embodiment. Accordingly, not only is the $H_{11}$ mode physically separated from the TE mode, but it is located outside of the dielectric material and, therefore, is substantially attenuated as well as pushed upwardly in frequency.

Hence, in contrast to the prior art, the problematic $H_{11}$ interference mode is rendered insignificant in the conical resonators of the aforementioned patent application with virtually no incumbent attenuation of the TE mode. As discussed in detail in the aforementioned patent application, the larger mode separation combined with the physical separation of the TE and $H_{11}$ modes enables the tuning of the center frequency of the TE mode without significantly affecting, the center frequency of the $H_{11}$ mode. Conical resonators also substantially improve the suppression of the $TM_{01}$ mode, which is the other spurious mode that often is of concern. In fact, because a conical resonator destroys the homogeneity in the longitudinal direction of the resonator and also because an appropriately dimensioned through hole in the resonator substantially attenuates the $TM_{01}$, mode, the $TM_{01}$ mode is actually quite difficult to excite in a conical resonator and can be excited only if the tuning plate is very close to the resonator, i.e., almost touching. Such close positioning of a tuning plate to the resonator is undesirable for other reasons. For example, it will significantly reduce the quality factor Q of the operating TE mode. Thus, conical resonators generally are superior to conventional cylindrical resonators with respect to minimizing interference from spurious modes such as the $TM_{01}$ and $H_{11}$ modes. On the other hand, it is quite easy to to support the $TM_{01}$ mode near the frequency of the TE mode in a conventional cylindrical resonator through the interactions of the tuning plate, tuning screws, cavity and the cylindrical resonator.

U.S. patent application Ser. No. 10/268,415 discloses a number of other embodiments in accordance with the principles of the invention as outlined above. In this specification, we shall discuss the present invention in the context of a conical resonator such as illustrated in FIGS. 4 and 6. However, it should be understood that the present invention is applicable to essentially any resonator in which the strength of the field of interest is longitudinally variable adjacent to the resonator. For instance, the present invention can be applied to cylindrical and other prior art resonators because, in fact, the field strength is longitudinally variable at least near the longitudinal ends of such resonators.

However, the benefits of the present invention can best be utilized in connection with resonators in which the cross-sectional area of the resonator parallel to the electric field lines of the TE mode is variable as a function of the longitudinal direction (i.e., the direction perpendicular to the field lines of the TE). Preferably, the cross-sectional area varies monotonically as a function of height, but this is not a requirement, The cross-sectional area merely should vary on average in one direction (e.g., decrease) over a substantial portion of the overall height of the resonator. For instance, see FIG. 9F of U.S. patent application Ser. No. 10/268,415. As another example, a resonator body comprising two inverted cones that meet at their apexes still would have the desirable property of having variable TE mode strength in the longitudinal direction.

Figure 7:
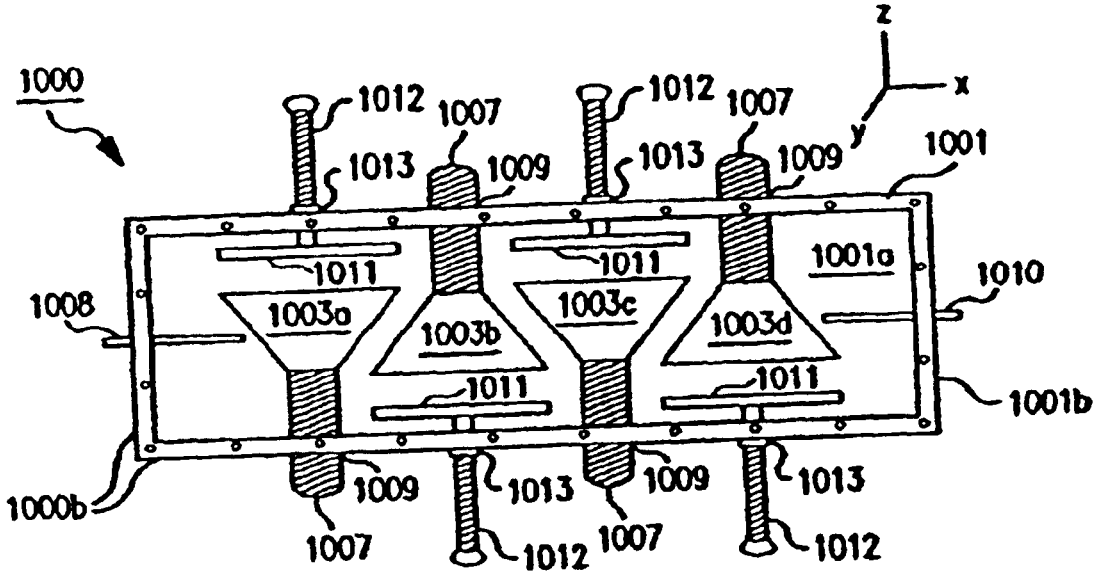
FIG. 7 is a perspective view of a microwave filter employing conical dielectric resonators in connection with which application of the present invention is particularly suitable.

FIG. 7 is a top plan view of an exemplary microwave filter employing conical resonators in accordance with the present invention. As shown, the filter 1000 comprises an enclosure 1001 having a bottom wall 1001*a*, a lateral wall 1001*b*, and a top wall (not shown for purposes of allowing the internal components to be seen) to form a complete enclosure. The enclosure 1001 of FIG. 7 is rectangular and the resonators are arranged so that their longitudinal axes are parallel to each other, but not collinear, and they are all generally near the same plane perpendicular to their longitudinal axes. As will be discussed in detail below, the positions of the resonators relative to each other preferably are longitudinally adjustable. A plurality of resonators 1003 are arranged within the housing in any configuration suitable to achieve the performance goals of the circuit. Preferably, each resonator is longitudinally inverted relative to its adjacent resonator or resonators. Thus, resonator 1003*a* is upside down, resonator 1003*b* is right side up, resonator 1003*c* is upside down, etc.

The primary reasons for the preference of inverting each resonator relative to the adjacent resonators are so that the TE mode electric fields can be brought even closer to each other and to reduce the size of the filter. Specifically, the resonators can be packed into a smaller space by alternately inverting them. Furthermore, this arrangement of resonators provides greater design flexibility because it allows the position of the resonators (and thus their TE mode fields) relative to each other to be adjustable in all three dimensions, whereas, in prior art circuit designs, the positions of the resonators were adjustable only laterally with respect to each other (i.e., in only two dimensions). Particularly, because the TE mode fields are concentrated in the bases of the resonators, the field of one resonator is displaced from the field of the adjacent, inverted resonator longitudinally (the z axis in FIG. 7) as well as transversely (the x and y axes in FIG. 7). Thus, by inverting adjacent conical resonators and spacing the resonators very close to each other in the lateral direction, the base of one resonator may be positioned almost directly above the base of an adjacent resonator such that there is almost no lateral (x,y) displacement between the bases of the two resonators, only a longitudinal displacement. Hence, the TE mode field of one resonator can be placed right above the TE mode field of the adjacent resonator, if particularly strong coupling is desired. On the other hand, if less coupling is desired, the displacement between the two resonators can be increased longitudinally and/or laterally.

In prior art circuit designs, in which the TE field strength generally did not vary along the height of the resonators (except at the very ends of the resonators), the perception was that there was no need or benefit to longitudinal displacement of the resonators relative to each other.

FIG. 7 schematically shows a generic input coupler 1008 through which microwave energy is supplied to the circuit. The input coupler 1008, for instance, may receive energy from a coaxial cable (not shown) connected to the coupler outside of the enclosure. The coupler 1008 is positioned through the wall of the enclosure near the first resonator 1003*a*, and the output is received at an output coupler 1010 positioned near the last resonator 1003*d*.

The couplers 1008, 1010 are shown schematically since they may be any coupling means known in the prior art or discovered in the future for coupling energy into a dielectric resonator, including by microstrips formed on a surface of the enclosure or by use of coupling loops as described in the background section of this specification.

In the preferred embodiment illustrated in FIG. 7, the displacements of the conical resonators relative to each other are fixed in the transverse direction as a function of the design, but are adjustable in the longitudinal direction after assembly. Particularly, the resonators 1003 are mounted on screws 1007 that are screwed into matingly threaded through holes 1009 in side walls 1001*b* of the enclosure. Particularly, the longitudinal central through holes 1005 in the resonators 1003 are also threaded to mate with the screws 1007. Accordingly, the longitudinal position of the resonator can be adjusted by rotating the screw 1007 relative to one or both of the holes in the enclosure 1001 or the longitudinal holes in the resonators 1003. If the holes in the enclosure are through holes, the resonator spacing, and thus the bandwidth of the filter, can be adjusted without even opening the enclosure 1001, but rather simply by rotating the ends of the screws that protrude from the enclosure.

Since there are no irises, coupling screws, or separating walls between the resonators, and the design of the resonators and the system inherently provides for wide flexibility of coupling between adjacent resonators, a system can be easily designed in which the enclosure 1001 plays an insignficant role in the electromagnetic performance of the circuit. Accordingly, instead of being required to fabricate the housing extremely precisely and out of a conductive material (e.g., metal) in order to provide suitable electromagnetic characteristics, the enclosure can be fabricated using a low-cost molding or casting process, with lower cost materials and without the need for precision or other expensive milling operations, thus substantially reducing manufacturing costs. In addition, the screws 1007 for mounting the resonators in the enclosure also can be made out of a non-conductive material and/or without concern for their effect on the electromagnetic properties of the system.

The system may further include circular conductive tuning plates 1011 adjustably mounted on the enclosure 1001 for longitudinal adjustment relative to the bases of the resonators 1003. These plates may be mounted on non-conductive screws 1012 that pass through holes 1013 in the enclosure 1001 to provide adjustability after assembly. As in the prior art, these tuning plates are used to adjust the center frequency of the TE mode of the resonators.

The mounting of the resonators and/or tuning plates on screws so that they can be longitudinally adjustable for center frequency and bandwidth tuning can be applied to conventional, cylindrical dielectric resonators also, but would likely provide inferior performance characteristics to a filter with conical resonators. However, it would provide a useful filter, particularly for narrow band filters, e.g., filters with bandwidths of less than about 10 MHz.

By providing movable conical resonators, the invention of application Ser. No. 10/268,415 provides controlled strong coupling, whereby lowpass or highpass filters can be replaced with very broad bandpass or very broad band-stop filters that are almost lossless.

B. Coupling Loops

Figure 1:
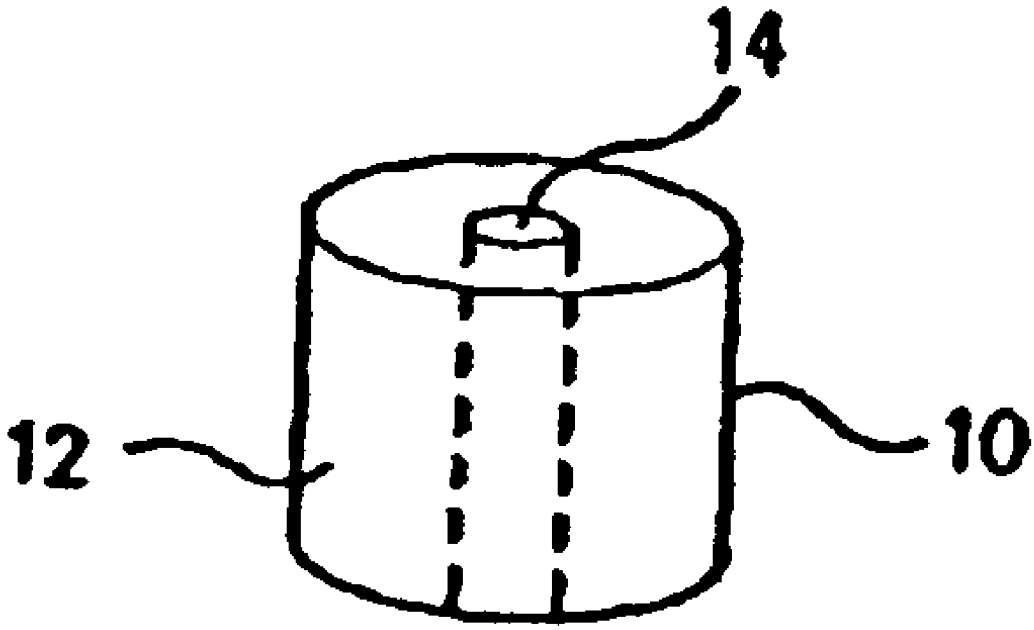
FIG. 1 PRIOR ART
FIG. 1 is a perspective view of a cylindrical dielectric resonator of the prior art.
Figure 2:
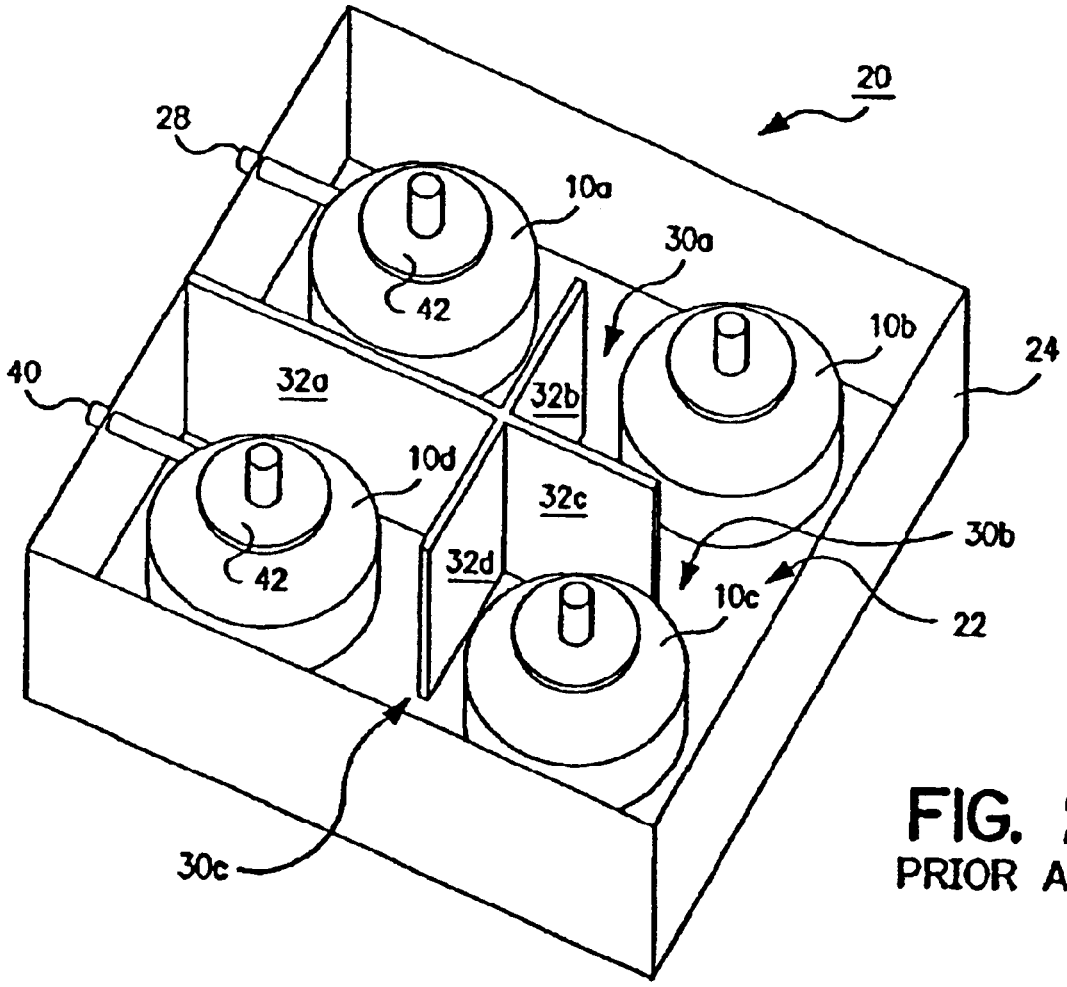
FIG. 2 PRIOR ART
FIG. 2 is a perspective view of an exemplary microwave dielectric resonator filter of the prior art.
Figure 3:
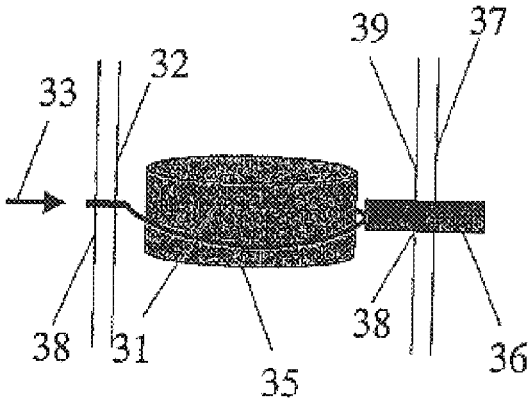
FIG. 3 (PRIOR ART)
FIG. 3 is a perspective view of an exemplary input or output coupling loop and corresponding dielectric resonator for coupling a signal into or out of a dielectric resonator circuit in accordance with the prior art.
Figure 8:
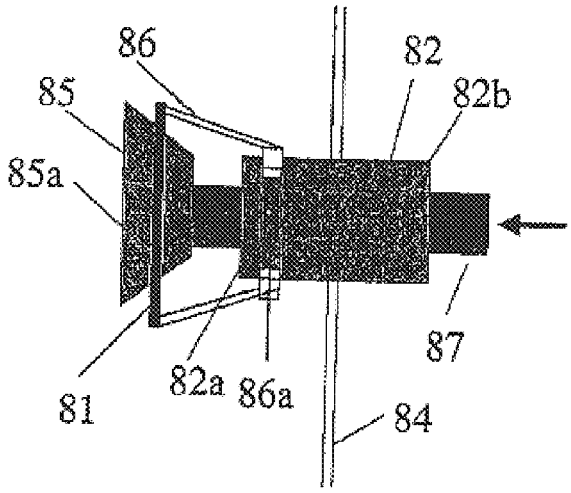
FIG. 8 is a perspective view of an input or output coupling loop and corresponding dielectric resonator for coupling a signal into or out of a dielectric resonator circuit in accordance with the present invention.

FIG. 8 is a side view of an exemplary microwave coupling loop and associated dielectric resonator in accordance with the present invention for coupling signals into and out of a dielectric resonator circuit. The coupling loops of the present invention are specifically designed for use with the dielectric resonators disclosed in aforementioned U.S. patent application Ser. No. 10/268,415, but are not limited to such resonators. A coupling loop in accordance with the present invention can be employed as either an input coupler or an output coupler for a dielectric resonator filter or other circuit. In accordance with a preferred embodiment of the present invention, the coupling loop 81 is mounted on a threaded screw 82 that passes through and engages mating threads of a hole 83 in a wall of the circuit. The coupling loop in accordance with the present invention may be a closed loop coupler (to provide magnetic coupling) or an open loop coupler (to provide electrical coupling). It is fixedly mounted to the screw 82 via a cage 86 extending from the distal end 82*a* of the screw. The cage 86 may comprise a proximal band 86*a* that surrounds the screw 82 and bears threads on its inner circumferential surface 86*b* so that the position of the cage 86 and, thus, the coupling loop 81 is longitudinally adjustable by rotation of the cage 86 relative to the screw 82 and/or rotation of the screw 82 relative to the hole 83 in the housing 84

The screw 82 is hollow and its inner circumferential surface 82*b* is threaded to mate with the threads of a second threaded screws 87 that holds the resonator. The second screw 87 passes through the hollow portion of the coupling loop screw 82 and matingly engages the threaded inner circumferential surface 82*b* of the hollow screw. The central through hole 85*a* in the resonator 85 also may be threaded to matingly engage the external threads of the second screw 87 so that the resonator position is longitudinally adjustable relative to the housing 84, the other resonators in the housing, and the coupling loop 81 by rotation of any of (1) the second screw 87 relative to the through hole 85*a* in the resonator 85, (2) the second screw 87 relative to the first screw 82, or (3) the first screw 82 relative to the through hole 83 in the housing 84.

In accordance with this invention, the longitudinal position of the coupling loop 81 relative to the resonator 85 as well as the longitudinal position of the resonator 85 relative to the housing 84 and other resonators are both adjustable fully independently of each other. Particularly, the longitudinal position of coupling loop 81 relative to the resonator 85 is adjustable by rotating the coupling loop mounting screw 82 relative to the resonator mounting screw 87 and/or by rotating the cage 86 relative to the hollow screw 82. Accordingly, both the coupling loop 81 and the resonator 85 are fully independently adjustable relative to each other, to the housing, and to the other dielectric resonators in the circuit.

Because the resonator 85 preferably is conical, longitudinal adjustment of the coupling loop 81 relative to the resonator 85 will strongly affect many parameters of the circuit, including coupling strength, bandwidth, return loss, and quality factor (Q). In at least one preferred embodiment, the mounting cage 86 and the hollow screw 82 are conductive and the input or output signal is coupled to or from the loop 81 through the cage 86 and hollow screw 82 (to the coaxial cable or other external signal transport medium). In such an embodiment, the coaxial cable or other external signal medium (not shown) is adapted to electrically connect to the screw 82. Any number of designs are possible and would be derivable by persons of skill in the related arts.

Alternately, the coupling loop 81 can couple to the external signal source/destination via structure entirely separate from the cage and/or hollow screw 82.

While the invention is particularly suitable for conical resonators because of the longitudinal variability of the TE mode, it is perfectly applicable to other resonators, including prior art cylindrical resonators. Since the TE mode is not nearly as longitudinally variable in a prior art cylindrical resonator as it is in conical resonators, the most effective way to vary coupling strength by longitudinal adjustment of the coupling loop with a cylindrical resonator would be to place the coupling loop near one of the longitudinal ends of the resonator, where the TE mode field drops off rapidly as one moves beyond the longitudinal ends of the resonator.

Figure 9A:
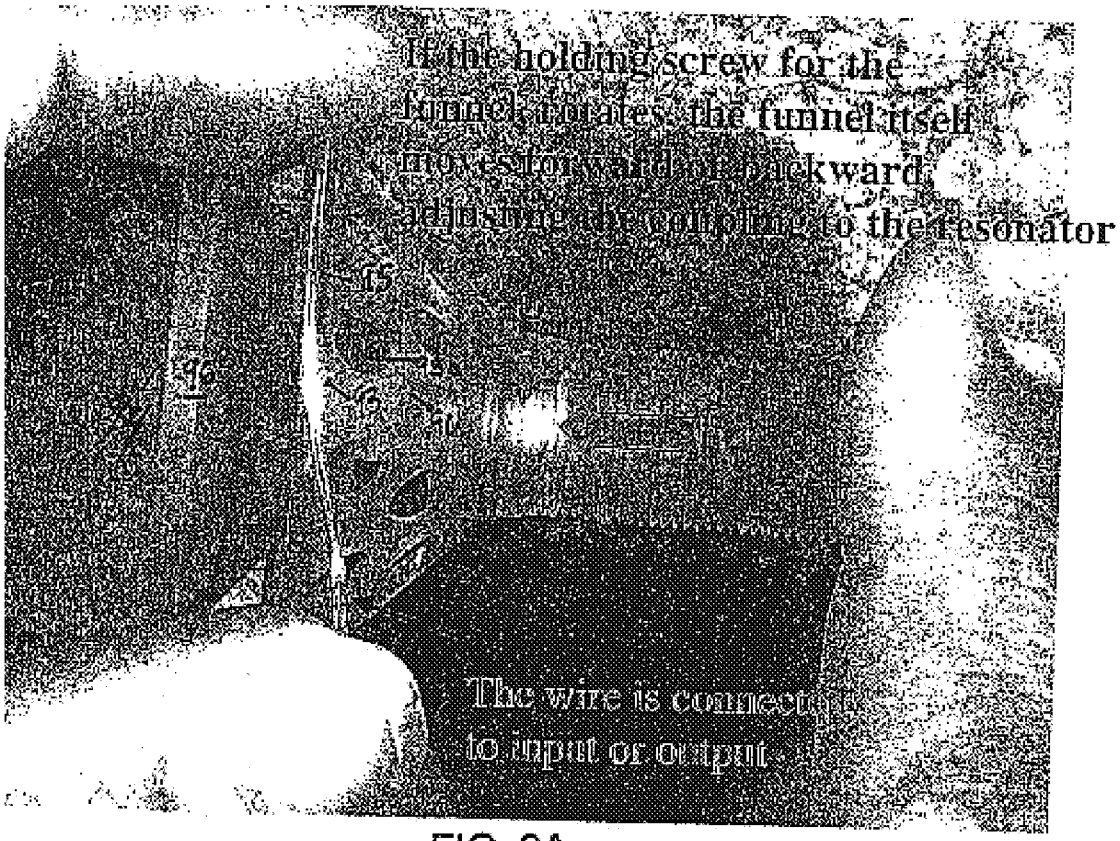
FIGS. 9A and 9B are side and end views, respectively, of an exemplary practical embodiment of the invention.
Figure 9B:
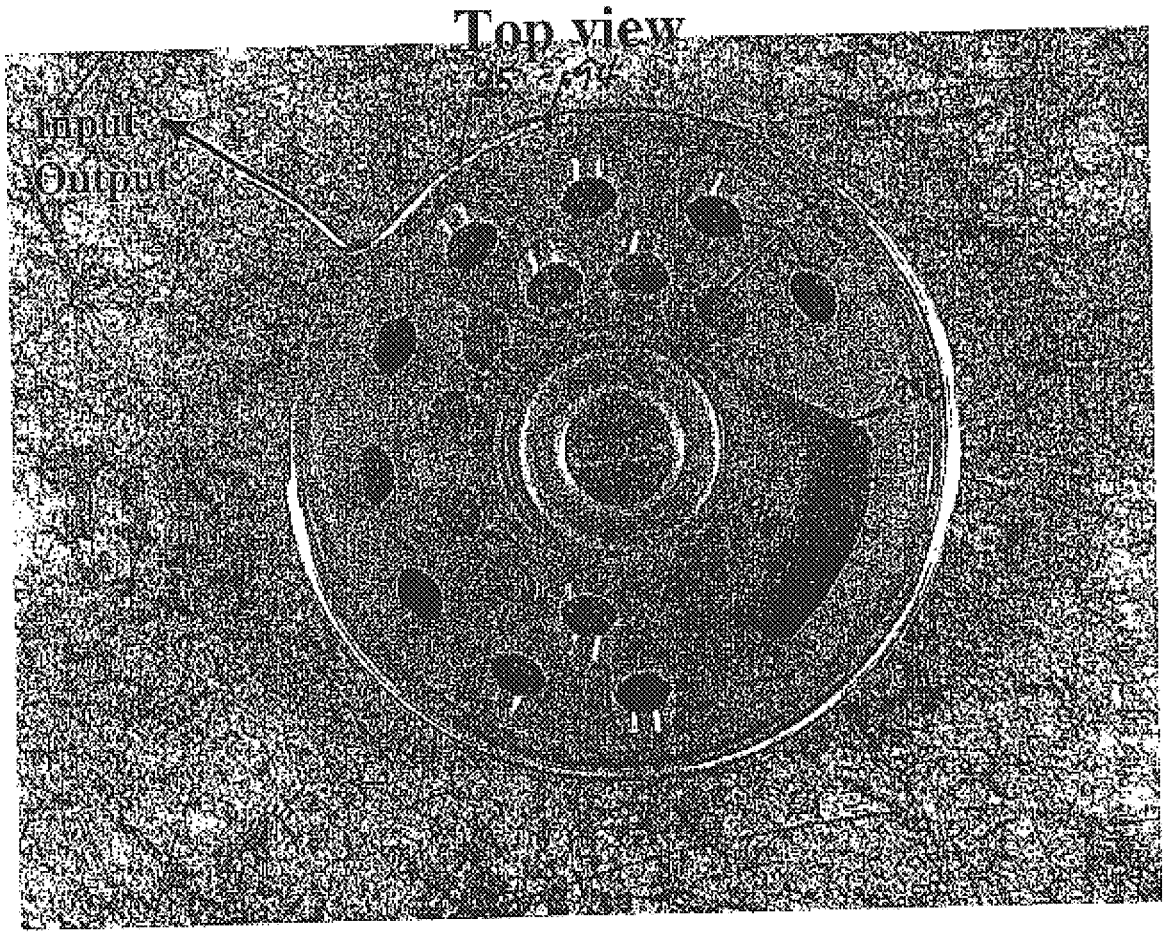

FIGS. 9A and 9B show one practical embodiment of the present invention in which the inner and outer screws 91 and 92 are made of plastic, such as nylon. The cage 93 is mounted on the end of the outer screw 92 via an interference fit between the screw 92 and a circular central opening 93*a* in the cage. A larger opening 93*b* is contiguous with the central opening 93*a* that allows the cage to be freely slipped over the end of outer screw 92 and then slid sideways to cause the screw to enter the central opening 93*a* and form an interference fit therewith. The arc defined by the meeting of the central circular opening 93*a* with the larger opening 93*b* can be sized slightly smaller than the diameter of the outer screw 92 so that the cage resiliently snaps into place around the outer screw 92. The outer screw 92 may have a circumferential groove (not seen in the Figures) of approximately the same thickness as the thickness of the cage to mate with the central opening in the cage so that the cage 93 can snap onto the screw 92 only within that groove. In such an embodiment, the diameter of the groove in the screw, rather than the diameter of the screw would be selected to be equal to (or slightly larger than, if a snap fit is desired) the diameter of the central circular opening 93*a* in the cage. Alternately, the cage can be integrally formed as part of the outer screw 92. The cage 93 includes a plurality of holes 93*c* so as to reduce the material around the resonator 96 and lessen losses.

The metal coupling loop 95 should be mounted on the cage 93 in any reasonable manner so that it is coaxial with the screws 91, 92 and the resonator 96. For instance, a channel 94 may be formed in the periphery of the cage 93 within which the loop 95 can be snapped into place, thereby forming an interference fit with the channel. The loop has an end 95*a* that extends radially outwardly which end 95*a* can be coupled to an input or output coupling. The loop can alternately or additional be affixed to the cage, such as by adhesive. However, if the cage is integrally formed as part of the outer screw 92, then it would be preferable for the wire loop to fit slidingly within the channel 94 so that the screw 92 and cage 93 can be rotated without also causing the loop to rotate. This would allow the loop end 95*a* to be coupled to a fixed input or output point on the housing of the filter while still allowing for longitudinal adjustment of the loop relative to the resonator by rotation of the screw and cage. The end 95*a* of the loop can bend slightly to adapt to the relatively small longitudinal movements of the loop during tuning. However, the loop 95 is not amendable to wholesale rotation thereof while the end 95*a* remains attached to a fixed point.

Figure 10:
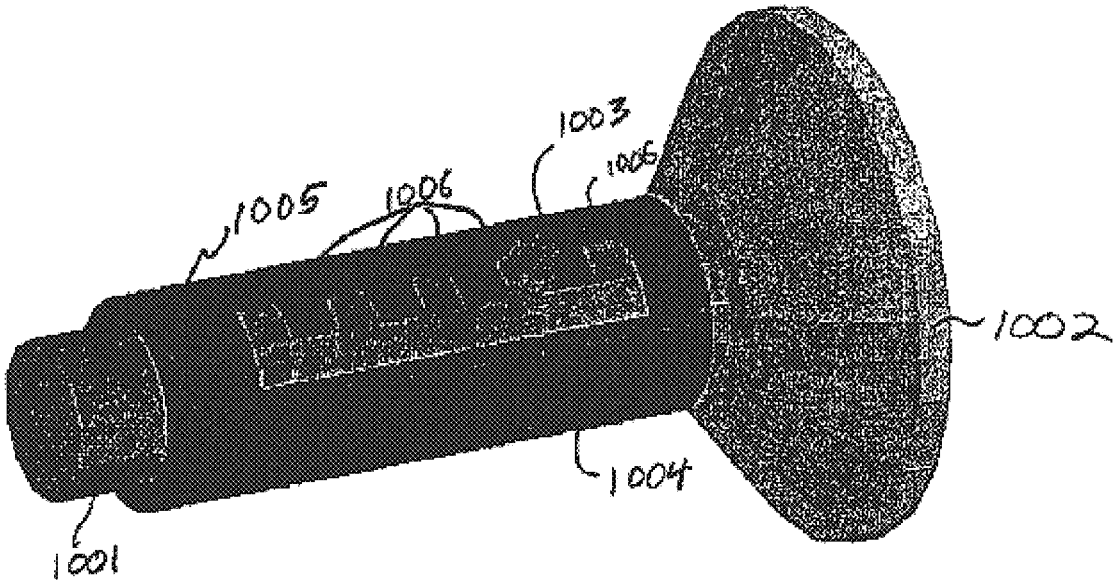
FIG. 10 is a perspective view of another embodiment of the invention.

While the present specification has disclosed particular embodiments of the invention in which the coupling loop and dielectric resonator are made adjustable relative to each other and the housing by matingly threaded screws, other mechanical means of allowing two coaxial posts or other supports to be longitudinally adjustable relative to each other may be employed. For example, FIG. 10 shows an embodiment in which the inner post 1001 carrying the resonator 1002 bears a radially outwardly extending pin 1003 that rides in a longitudinal slot 1004 in the wall of the outer post 1005. The longitudinal slot 1004 has additional slots 1006 extending transversely therefrom within which the pin 1003 may be seated by rotating the inner post 1001 slightly when the pin 1003 is longitudinally adjacent one of the transverse slots 1006. Such an embodiment would provide longitudinal adjustment in discrete steps, rather than the infinitely variable longitudinal adjustment of the screw type embodiments. A similar scheme can be used to couple the outer post to the housing. For instance, the outer post may include a plurality of longitudinally spaced pins along its outer circumferential wall, the hole in the housing through which the outer post passes may have a longitudinal slot running the entire width of the wall, and a transverse slot in the inner circumferential wall of the hole. The post can pass freely through the hole by aligning the pins with the longitudinal slot until the desired pin is adjacent the transverse slot in the hole and the post can be rotated to cause the selected pin to engage the transverse slot and, thereby, longitudinally fix the outer post. Other discrete step mechanisms also are possible. As an even further alternative, any or all of the inner post, the outer post and the housing may be formed of a frictional, slightly resilient material so that the two posts and/or the hole in the housing may engage by a simple friction fit which allows infinite adjustability of the two posts longitudinally.

Having thus described a few particular embodiments of the invention, various other alterations, modifications, and improvements will readily occur to those skilled in the art. Such alterations, modification and improvements as are made obvious by this disclosure are intended to be part of this description though not expressly stated herein, and are intended to be within the spirit and scope of the invention. Accordingly, the foregoing description is by way of example, and not limiting. The invention is limited only as defined in the following claims and equivalents thereto.

We claim:

1. A dielectric resonator circuit comprising:

a housing;

a dielectric resonator having a longitudinal axis and positioned within said housing;

a coupling loop for coupling energy to or from said dielectric resonator;

a first mounting post coupled to said dielectric resonator and passing through a hole in said housing for supporting said dielectric resonator relative to said housing; and a second mounting post coupled to said coupling loop, said second mounting post being hollow and passing through said hole in said housing and being coaxial with said first mounting post, said coupling loop supported on and extending from said second mounting post and surrounding said dielectric resonator;

wherein said dielectric resonator is mounted to said housing via said first mounting post such that said dielectric resonator is longitudinally adjustable relative to said housing and wherein said coupling loop is mounted to said housing via said second mounting post such that said coupling loop is independently longitudinally adjustable relative to said housing and said dielectric resonator.

2. The dielectric resonator circuit of claim 1 wherein said first mounting post is a first screw with external threads, said second mounting post is a second screw with internal threads configured to threadingly mate with said external threads of said first screw, and said second screw further comprises external threads, and said hole in said housing is internally threaded to mate with said external threads of said second mounting post, whereby said coupling loop and said dielectric resonator are longitudinally adjustable relative to each other and said housing via relative rotation of said first and second mounting posts and said hole in said housing.

3. The dielectric resonator circuit of claim 1 wherein said first and second mounting posts have longitudinal axes and said longitudinal axes of said first and second mounting posts are parallel to said longitudinal axis of said dielectric resonator.

4. The dielectric resonator circuit of claim 3 wherein said longitudinal axes of said first and second mounting posts are coaxial with said longitudinal axis of said dielectric resonator.

5. The dielectric resonator circuit of claim 1 wherein said dielectric resonator comprises a longitudinal through hole, said longitudinal through hole having internal threads, said first mounting post is a screw having external threads configured to mate with said internal threads of said dielectric resonator through hole, whereby said dielectric resonator is longitudinally adjustable relative to said housing and said coupling loop via rotation of said dielectric resonator relative to said first screw.

6. The dielectric resonator circuit of claim 5 wherein said second mounting post is a second screw having external threads, and said hole in said housing is internally threaded to mate with said external threads of said second screw, whereby said coupling loop is longitudinally adjustable relative to said housing via rotation of said second screw relative to said hole in said housing.

7. The dielectric resonator circuit of claim 6 wherein said second screw is internally threaded to also mate with said external threads of said first screw, whereby said dielectric resonator is longitudinally adjustable relative to said housing and said coupling loop further via rotation of said first mounting post relative to said second mounting post and said hole in said housing.

8. The dielectric resonator circuit of claim 1 further comprising a support structure for supporting said coupling loop on said second mounting post and wherein said support structure and said second mounting post are matingly threaded so that said longitudinal position of said coupling loop is adjustable relative to said second mounting post via rotation of said support structure relative to said second mounting post.

9. The dielectric resonator circuit of claim 8 wherein said second mounting post is internally threaded to also mate with said external threads of said first mounting post, whereby said coupling loop also is longitudinally adjustable relative to said housing and said dielectric resonator via rotation of said first mounting post relative to said second mounting post and said hole in said housing.

10. The dielectric resonator circuit of claim 1 wherein said first mounting post is non-conductive.

11. The dielectric resonator circuit of claim 1 wherein said second mounting point is conductive.

12. The dielectric resonator circuit of claim 11 further comprising a support structure extending from a distal end of said second mounting post supporting said coupling loop on said second mounting post and wherein said support structure is conductive.

13. The dielectric resonator circuit of claim 12 wherein said housing is non-conductive and wherein said energy is coupled into or out of said coupling loop through said second mounting post and said support structure.

14. The dielectric resonator circuit of claim 13 further comprising an electrical connector at a proximal end of said second mounting post configured to mate to a conductor for coupling said energy between said conductor and said second mounting post.

15. The dielectric resonator circuit of claim 1 wherein said second mounting post is conductive and said energy is coupled into or out of said coupling loop through said second mounting post.

16. The dielectric resonator circuit of claim 1 wherein said coupling loop is a closed loop and is positioned coaxial with and completely surrounding said dielectric resonator.

17. The dielectric resonator circuit of claim 1 wherein said coupling loop is an open loop and is positioned coaxial with said dielectric resonator.

18. The dielectric resonator circuit of claim 1 wherein said dielectric resonator has a cross-section perpendicular to said longitudinal axis that varies as a function of longitude.

19. The dielectric resonator circuit of claim 18 wherein said cross-section varies monotonically as a function of longitude.

20. The dielectric resonator circuit of claim 19 wherein said dielectric resonator is conical.

21. The dielectric resonator circuit of claim 20 wherein said dielectric resonator is a truncated cone.

22. A dielectric resonator circuit comprising:

a housing;

an input coupling loop for coupling energy into said dielectric resonator circuit;

a first dielectric resonator positioned within said housing;

a first mounting post having a longitudinal axis on which said input coupling loop is supported surrounding said first dielectric resonator, said first mounting post passing through a first hole in said housing and having a longitudinal through hole, said first counting post adapted such that said input coupling loop is moveable longitudinally relative to said housing;

a second mounting post upon which said dielectric resonator is supported, said second mounting post coaxial with and positioned within said through hole of said first mounting post and adapted to be longitudinally adjustable relative to said first mounting post;

at least one second dielectric resonator positioned to electrically couple with said first dielectric resonator;

a third dielectric resonator positioned within said housing;

an output coupling loop for coupling energy out of said dielectric resonator circuit;

a third mounting post on which said output coupling loop is supported so as to surround said third dielectric resonator, said third mounting post passing through a second hole in said housing and having a longitudinal through hole, said third mounting post configured such that said output coupling loop is moveable longitudinally relative to said housing; and a fourth mounting post upon which said second dielectric resonator is supported, said fourth mounting post coaxial with and positioned within said through hole of said first mounting post and longitudinally adjustable relative to said third mounting post.

23. The dielectric resonator circuit of claim 22 wherein said second and fourth mounting posts are externally threaded, said first and third mounting posts are internally threaded to mate with said external threads of said second and fourth mounting posts, respectively, said second and fourth mounting posts further are externally threaded, and said first and second holes in said housing are internally threaded to mate with said external threads of said second and fourth mounting posts, respectively, whereby said input coupling loop and said first dielectric resonator are longitudinally adjustable relative to each other and said output coupling loop and said dielectric resonator are longitudinally adjustable relative to each other, respectively, via relative rotation of said first and second mounting posts and said third and fourth mounting posts, respectively.

24. The dielectric resonator circuit of claim 1 wherein said first and third mounting posts are conductive.

25. The dielectric resonator circuit of claim 22 further comprising a support structure extending from a distal end of each of said first and third mounting posts supporting said input and output coupling loops on said first and third mounting posts, respectively.

26. The dielectric resonator circuit of claim 25 wherein said support structures are conductive and said energy is coupled into or out of said coupling loops via said first and third mounting posts and said support structures.

27. The dielectric resonator circuit of claim 26 wherein said housing is non-conductive.

28. The dielectric resonator circuit of claim 22 wherein said dielectric resonators have cross-sections perpendicular to said longitudinal axes that vary as a function of longitude.

29. The dielectric resonator of claim 28 wherein said dielectric resonators are conical.

30. The dielectric resonator of claim 29 wherein said dielectric resonators are truncated cones.

* * * * *